US008569663B2

(12) United States Patent
Qin et al.

(10) Patent No.: US 8,569,663 B2
(45) Date of Patent: Oct. 29, 2013

(54) SMALL-SIZED POOL AND PTC HEATER FOR INTERNAL LIQUID HEATING

(76) Inventors: Huarong Qin, Shanghai (CN); Zhongxiu Zhang, Shanghai (CN); Minhua Wu, Shanghai (CN)

( * ) Notice: Subject to any disclaimer, the term of this patent is extended or adjusted under 35 U.S.C. 154(b) by 0 days.

(21) Appl. No.: 13/814,727

(22) PCT Filed: Jul. 27, 2011

(86) PCT No.: PCT/CN2011/001229

§ 371 (c)(1), (2), (4) Date: Apr. 9, 2013

(87) PCT Pub. No.: WO2012/027947

PCT Pub. Date: Mar. 8, 2012

(65) Prior Publication Data

US 2013/0191985 A1 Aug. 1, 2013

(30) Foreign Application Priority Data

Aug. 31, 2010 (CN) ..... 2010 1 0270168
Jun. 1, 2011 (CN) ..... 2011 1 0145820
Jun. 14, 2011 (CN) ..... 2011 1 0158866

(51) Int. Cl.
*H05B 3/03* (2006.01)
*H05B 3/12* (2006.01)

(52) U.S. Cl.
USPC ..... 219/505; 219/494; 219/542; 219/544; 219/552; 4/545; 4/541.1

(58) Field of Classification Search
CPC ..... H05B 3/04; H05B 3/12; H05B 1/283
USPC ..... 219/504, 505, 494, 542, 544, 552; 4/545, 541.1
See application file for complete search history.

(56) References Cited

U.S. PATENT DOCUMENTS 4,631,391 A * 12/1986 Tiepke ..... 219/541
4,835,370 A * 5/1989 Van Bokestal et al. ..... 219/544
6,278,596 B1 * 8/2001 Simpson ..... 361/42
6,393,213 B1 * 5/2002 Bresolin ..... 392/498

FOREIGN PATENT DOCUMENTS

CN 2807128 Y 8/2006
CN 2816679 Y 9/2006
CN 201146614 Y 11/2008
CN 201499325 U 6/2010
CN 101945505 A 12/2011

* cited by examiner

*Primary Examiner* — Mark Paschall
(74) *Attorney, Agent, or Firm* — Clement Cheng

(57) ABSTRACT

The present invention involves a type of small-sized pool and PTC heater for liquid heating. The PTC heating component of PTC heater is composed of several heating cores made of PTC ceramic material, completely eliminating fire risk. Meanwhile, PTC heating component external is equipped with at least one layer of insulation and sealing component, which further includes several insulation layers and at least one sealing layer outside the insulation layer, effectively eliminating electricity leakage risk. Two layers of above mentioned insulation and sealing component could meet the insulation requirements specified in IEC standard and UL standard, so it could be used for applications with large power. In addition, the PTC heater has good water route sealing ability, so it could be used for liquid heating in small size pool. The small-sized pool is equipped with PTC heater with several layers of insulation and sealing for liquid heating, safe and reliable.

12 Claims, 1 Drawing Sheet

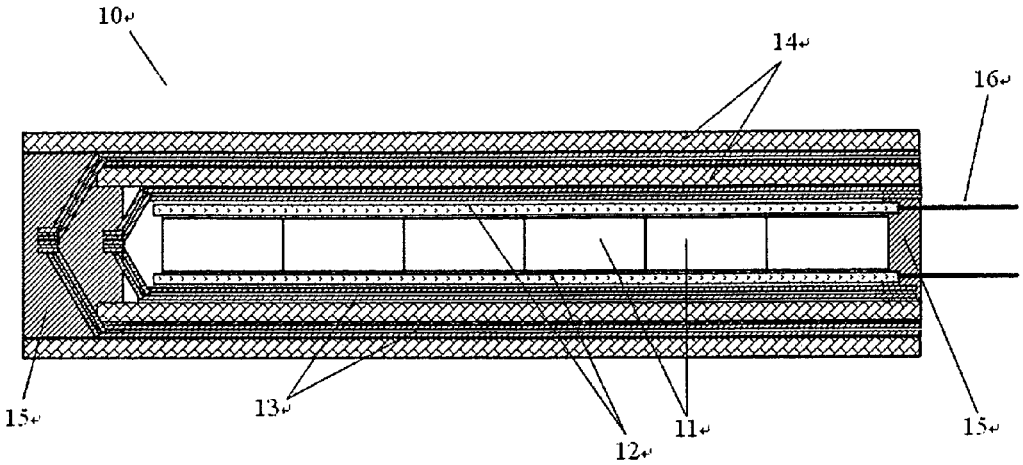
10
14
16
15
13
12
11
15

SMALL-SIZED POOL AND PTC HEATER FOR INTERNAL LIQUID HEATING

TECHNICAL FIELD

The present invention involves a type of household or industrial liquid heater and the pool equipped with the heater, especially the PTC heater with multiple insulation sealing component and the small-sized pool using this PTC heater for internal liquid heating.

TECHNICAL BACKGROUND

Currently, liquid is generally heated through electric heater or electromagnetic heater. Radiation generated during electromagnetic heating is harmful to human body, with poor operational safety. Electric heating pipe is prone to condensate scale, results in pipe explosion and electricity leakage, easily causing safety-related accidents. In addition, electric heating pipe uses high temperature open firing for heating, which may cause fire in case of water shortage and dry burn.

In recent years, the PTC (Positive Temperature Coefficient) heating mode of which PTC heating component uses the heating core of PTC ceramic material has low surface temperature, eliminating open firing risk to some extent. Therefore, it has been widely used in fan heater, hair curler and other low occasions with power consumption. However, existing PTC heater for liquid heating is lack of solutions to prevent electricity leakage especially in applications with high power consumption, because existing PTC heater is only equipped with one-layer sealing and insulation component outside PTC heating component. If the water directly contacts with conductive heating element when heating vessel is ruptured, it will result in electricity leakage and affect the safety and practicality significantly.

INVENTION OPEN

The objective of present invention is to provide a PTC heater, equip with multiple insulation and sealing component outside the PTC heating component, so as to meet the insulation requirements specified in IEC standard and UL standard, with good water route seal ability, which could be applied for liquid heating in small size pool. Therefore, the other objective of this invention is to provide a kind of small size pool equipped with a PTC heater with multiple insulation and sealing.

To achieve the above objectives, the present invention is to provide a PTC heater, including PTC heating component, and at least one-layer insulation and sealing component outside the mentioned PTC heating component. Every mentioned insulation and sealing component further includes a number of insulation layers and at least one sealing layer outside insulation layers.

As to every mentioned insulation and sealing component, the insulation layer is multiple layers of insulation film which is wrapped outside the mentioned PTC heating component or wrapped outside other insulation and sealing components.

As to every mentioned insulation and sealing component, the sealing layer further includes heat-conducting shell, so that the insulation film and other wrapped insulation and sealing components or PTC heating component are placed in the shell; the sealing layer also includes waterproof insulation paste filled at openings of the shell two ends.

The insulation film is made of polyimide film or other materials with high-temperature resistance, good insulation properties and good thermal conductivity properties.

The shell is made of copper alloy, aluminum or other materials with good thermal conductivity properties.

The waterproof insulation paste is made of resin or other materials with good insulation, heat resistance and waterproof properties.

As to PTC heater, the PTC heating component and insulation and sealing component, multiple layers of insulation and sealing components, insulation film of every insulation and sealing component and the shell should be attached closely.

The present invention also provides a PTC heater with double insulation and sealing, which comprises:

PTC heating component, the first layer of insulation and sealing component outside PTC heating component, and the second layer of insulation and sealing component outside the first layer of insulation and sealing component;

The mentioned first layer of insulation and sealing component further includes several layers of insulation film wrapped outside PTC heating component, and heat-conducting shell outside several layers of insulation film.

The second layer of insulation and sealing component further includes several layers of insulation film wrapped outside the shell of the first layer of insulation and sealing component, as well as the heat-conducting shell outside several layers of insulation film.

The PTC heater also includes waterproof insulation paste filled at two ends openings of shell of the first layer and second layer of insulation and sealing components.

The insulation film is made of polyimide film or other materials with high-temperature resistance, good insulation properties and good thermal conductivity properties.

The shell is made of copper alloy, aluminum or other materials with good thermal conductivity properties.

The waterproof insulation paste is made of resin or other materials with good insulation, heat resistance and waterproof properties.

This invention also provides a kind of small size pool equipped with several PTC heater which is used to heat the contacting liquid in the pool.

The mentioned PTC heater includes PTC heating component and at least one-layer insulation and sealing component outside the mentioned PTC heating component.

As to every mentioned insulation and sealing component, there are multiple layers of insulation layer; the insulation layer is multiple layers of insulation film which is wrapped outside the mentioned PTC heating component or wrapped outside other insulation and sealing components.

As to every mentioned insulation and sealing component, there are multiple layers of sealing layer; the sealing layer further includes heat-conducting shell, so that the insulation film and other wrapped insulation and sealing components or PTC heating component are placed in the shell; Waterproof insulation paste is filled at openings of the shell two ends.

As to every mentioned insulation and sealing component, the insulation film is made of polyimide film or other materials with high-temperature resistance, good insulation properties and good thermal conductivity properties.

The shell is made of copper alloy, aluminum or other materials with good thermal conductivity properties.

The waterproof insulation paste is made of resin or other materials with good insulation, heat resistance and waterproof properties.

There is at least one PTC heater with insulation and sealing component which is dismountable or directly fixed in the small-sized pool.

There is at least one PTC heater with insulation and sealing component which directly contacts with liquid in the pool for heating.

Or, the PTC heater external is additionally equipped with insulation, sealing or conductive shell, so that the PTC heater could heat the liquid flowing through the shell.

In comparison with existing technologies, the small-sized pool and the PTC heater for internal liquid heating mentioned in present invention have the advantages as follows: the PTC heating component of the PTC heater uses the heating core of PTC ceramic material, with the feature of constant temperature, low surface temperature and no open firing, completing eliminating fire risk. Meanwhile, PTC heating component external is equipped with at least two layers of insulation and sealing component, each of which includes insulation layer wrapped by several layers of insulation film; conductive shell outside insulation layer has waterproof sealant as sealing layer at opening two ends. Therefore, if insulation layer or sealing layer with any layer of insulation and sealing component is damaged, other insulation and sealing components could play the protection role of insulation and sealing. In addition, PTC heater has good water route sealing ability, so that the PTC heater could be used for liquid heating in the pool. The small size pool mentioned in this invention enables all or at least part of human body (organism) to enter inside, and PTC heater with multiple layers of insulation and sealing is used for heating the liquid in the pool, safe and reliable.

BRIEF INTRODUCTION OF ATTACHED DRAWING

FIG. 1 is the structure profile drawing of PTC heater with two layers of insulation and sealing component, as mentioned in present invention.

BEST METHOD OF PRESENT INVENTION REALIZATION

The following will illustrate the detailed implementation of present invention in combination with attached drawing.

In present invention, the PTC heater 10 with multiple layers of insulation and sealing structure includes PTC heating component and at least one layer of insulation and sealing component outside PTC heating component. Every layer of insulation and sealing component further includes several insulation layers and multiple sealing layers outside insulation layer.

As shown in FIG. 1, we will take PTC heater 10 with two layers of insulation and sealing component as the example to illustrate the present invention.

The mentioned PTC heating component includes two oppositely positioned electrode plates 12, generally made of silver, copper, aluminum or other materials with good conductive performance. It also includes several heating cores 11 made of PTC ceramic material, with lower surface temperature (designed at 100-300 degrees), preventing the occurrence of open firing and pipe explosion. The heating cores 11 are arranged and mutually contacted between two electrode plates 12 along the longitudinal direction. The above two electrode plates 12 are connected with several wires 16 though welding or terminal connection. The wires 16 are drawn from the same end of two electrode plates 12. Silica gel insulating sleeve is set up on parts connecting wires 16 and electrode plates 12 to prevent electricity leakage.

In the case of setting up two layers of insulation and sealing component, the first layer of insulation and sealing component can uses polyimide film or other materials with high temperature resistance, good insulation properties and heat-conducting properties to generate insulation film 13, so that insulation film 13 could form several insulation layers of mentioned insulation and sealing component after PTC heating component external is wrapped with several layers.

Afterwards, there is at least one sealing layer outside several insulation layers 13, including the shell 14 with two ends breaking through which is made of copper alloy, aluminum alloy or other materials with good heat-conducting properties, as well as waterproof insulation paste 15 at two ends openings of shell 14. Waterproof insulation paste 15 can be made of resinous material, and 985 silicone rubber with good insulation, heat resistance and waterproof performance is preferred.

Similar to the structure of first layer, as to second layer of insulation and sealing component, insulation film 13 (polyimide film, etc.) is the insulation layer after wrapping several layers outside the shell 14 with the first layer of insulation and sealing component. Heat-conducting shell 14 is set outside several insulation films 13, waterproof insulation paste 15 is used at two ends openings as sealing layer. Then, several wires 16 connecting two electrode plates 12 in PTC heating component could be drawn out from one end of sealed shell 14.

Punching machine can be used to press the heating core 11, electrode plates 12 with insulation film 13 and shell 14 of the first layer of insulation and sealing component, as well as insulation film 13 and shell 14 of the second layer of insulation and sealing component from inside to outside, so that they could closely bonded with each other.

The above mentioned PTC heater 10 with two layers of insulation and sealing component could meet double insulation standards specified in IEC standard and UL standard. Similar with the structure of above mentioned two layers of insulation and sealing component, the PTC heater in present invention could be further expanded to more than two layers of insulation and sealing component, providing better product safety protection.

When PTC heater is equipped with multiple layers of insulation and sealing component, as to every layer of insulation and sealing component, insulation film 13 (polyimide film) is wrapped outside PTC heating component, or several layers are wrapped outside sealing layer of previous layer of insulation and sealing component to be insulation layer; shell 14 with good heat conduction (aluminum, etc.) is set outside insulation layer as the sealing layer. That is, external of innermost PTC heating component is equipped with several layers of "insulation film 13 and shell 14" protection structure sequentially. The PTC heating component, insulation film 13 and the shell 14 are closely fit with each other; the two ends openings are sealed with waterproof insulation paste 15 (985 silicon rubber, etc.).

The present invention also provides an artificial small sized tool, which is equipped with PTC heater 10 with two layers or more than two layers of insulation and sealing structure, heating the liquid in the pool. There is no limitation to the materials for small size pool which could be formed through air inflation to contain the liquid. The size of such pool should be sufficient to accommodate all or at least part of human body (or organism), such as fish tank, bath tub, SPA massage bathtub, or inflatable molding small size swimming pool.

PTC heater 10 with two layers or more than two layers of insulation and sealing component could be detachable or directly fixed in the small size pool. PTC heater 10 could directly heat the contacting liquid in the pool; or insulation, sealing or conductive shell is additionally equipped outside PTC heater 10, so that liquid flowing through the shell contacts with PTC heater 10 for heating.

As mentioned above, PTC heating component of PTC heater 10 uses several heating cores 11 made of PTC ceramic material, with the feature of constant temperature, low surface temperature and no open firing, completing eliminating fire risk. Meanwhile, PTC heating component external is equipped with at least two layers of insulation and sealing component, each of which includes insulation layer wrapped by several layers of insulation film 13; conductive shell 14 outside insulation layer has waterproof sealant as sealing layer at opening two ends. Therefore, if insulation layer or sealing layer with any layer of insulation and sealing component is damaged, other insulation and sealing components could play the protection role of insulation and sealing. In addition, PTC heater 10 has good water route sealing ability, so that the PTC heater 10 could be used for liquid heating in the pool. The small sized pool mentioned in this invention enables all or at least part of human body (organism) to enter inside, and PTC heater 10 with multiple layers of insulation and sealing is used for heating the liquid in the pool, safe and reliable.

Even though the present invention has been described in detail through above preferred examples, it should be appreciated that above description should not be considered as limitation of present invention. It is obvious that the present invention may have a variety of modifications and alternatives after technicians in this field read above information. Therefore, the protection scope of present invention should be defined by appended claim.

The invention claimed is:

1. A PTC heating component, wherein, said PTC heating component includes a PTC heating component, and at least one layer of insulation and sealing component outside the mentioned PTC heating component; each layer of said insulation and sealing component further includes a number of insulation layers and at least one sealing layer outside insulation layers.

2. The PTC heater of claims 1, wherein, as to each layer of said insulation and sealing component, the insulation layer is multiple layers of insulation film 13 which is wrapped outside the mentioned PTC heating component or wrapped outside other insulation and sealing components.

3. The PTC heater of claim 1 or 2, wherein, as to each said insulation and sealing component, the sealing layer further includes a heat-conducting shell 14, so that the insulation film 13 and other wrapped insulation and sealing components or PTC heating component are placed in the shell 14; the sealing layer also includes waterproof insulation paste 15 filled at openings of the shell 14 two ends.

4. The PTC heater of claim 3, wherein, the said insulation film 13 is made of polyimide film or other materials with high-temperature resistance, good insulation properties and good thermal conductivity properties.

5. The PTC heater of claims 3, wherein, the said shell 14 is made of copper alloy, aluminum or other materials with good thermal conductivity properties.

6. The PTC heater of claim 3, wherein, the said waterproof insulation paste 15 is made of resin or other materials with good insulation, heat resistance and waterproof properties.

7. The PTC heater of claim 4 or 5, wherein, in the said PTC heater, the said PTC heating component and the said insulation and sealing component, the said multiple layers of insulation and sealing components, insulation film 13 of every insulation and sealing component and the shell 14 should be attached closely.

8. A dual-layer insulation and sealing PTC heater, wherein, the said dual-layer insulation and sealing PTC heater includes, PTC heating component, the first layer of insulation and sealing component outside PTC heating component, and the second layer of insulation and sealing component outside the first layer of insulation and sealing component;

the said first layer of insulation and sealing component further includes several layers of insulation film 13 wrapped outside PTC heating component, and heat-conducting shell 14 outside several layers of insulation film 13;

the said second layer of insulation and sealing component further includes several layers of insulation film 13 wrapped outside the shell 14 of the first layer of insulation and sealing component, as well as the heat-conducting shell 14 outside several layers of insulation film 13;

the said PTC heater also includes waterproof insulation paste 15 filled at two ends openings of shell 14 of the first layer and second layer of insulation and sealing components.

9. The dual-layer insulation and sealing PTC heater of claim 8, wherein, the said insulation film 13 is made of polyimide film or other materials with high-temperature resistance, good insulation properties and good thermal conductivity properties;

the said shell 14 is made of copper alloy, aluminum alloy or other materials with good thermal conductivity properties;

the said waterproof insulation paste 15 is made of resin or other materials with good insulation, heat resistance and waterproof properties.

10. A small sized pool, wherein, said small sized pool is equipped with several PTC heaters 10 which are used to heat the contacting liquid in the pool;

the said heater 10 includes PTC heating component and at least two-layer insulation and sealing component outside the mentioned PTC heating component;

as to every said insulation and sealing component, there are multiple layers of insulation layer; the said insulation layer is multiple layers of insulation film 13 which is wrapped outside the mentioned PTC heating component or wrapped outside other insulation and sealing components;

as to every mentioned insulation and sealing component, there are multiple layers of sealing layer; the sealing layer further includes heat-conducting shell 14, so that the insulation film 13 and other wrapped insulation and sealing components or PTC heating component are placed in the shell 14; waterproof insulation paste 15 is filled at openings of the shell 14 two ends.

11. The small sized pool of claim 10, wherein, in the said every insulation and sealing component, the said insulation film 13 is made of polyimide film or other materials with high-temperature resistance, good insulation properties and good thermal conductivity properties, the said shell 14 is made of copper alloy, aluminum alloy or other materials with good thermal conductivity properties, the said waterproof insulation paste 15 is made of resin or other materials with good insulation, heat resistance and waterproof properties.

12. The small sized pool of claim 10 or claim 11, wherein, the said PTC heater 10 with at least two-layer insulation and sealing component is dismountable or directly fixed in the small-sized pool.

* * * * *